US005553794A

United States Patent [19]

Oliver et al.

[11] Patent Number: 5,553,794

[45] Date of Patent: Sep. 10, 1996

[54] SEWAGE HANDLING SYSTEM

[75] Inventors: Darrel S. Oliver, Tulsa, Okla.; Deborah C. Wynn, Ellicott City, Md.

[73] Assignee: Tarby Inc, Claremore, Okla.

[21] Appl. No.: 361,292

[22] Filed: Dec. 22, 1994

[51] Int. Cl.[6] ..... B02C 25/00; G01F 23/00; F16K 21/18

[52] U.S. Cl. ..... 241/36; 73/304 R; 137/386; 137/395; 307/118; 361/178; 417/36; 241/46.01

[58] Field of Search ..... 73/304 R, 304 C; 137/363, 386, 392, 395, 544, 565; 241/36, 46.01, 46.02; 307/118; 361/178; 417/36

[56] References Cited

U.S. PATENT DOCUMENTS

| | | | |
|---|---|---|---|
| 3,318,248 | 5/1967 | Rembold | 241/36 |
| 3,667,692 | 6/1972 | Grace | 241/36 |
| 3,857,517 | 12/1974 | Grace et al. | 241/36 |
| 3,904,131 | 9/1975 | Farrell, Jr. et al. | 241/46.02 |
| 4,014,475 | 3/1977 | Grace et al. | 241/36 |
| 4,551,068 | 11/1985 | Boudreaux | 417/8 |
| 4,739,786 | 4/1988 | Parkinson | 137/2 |
| 4,822,213 | 4/1989 | Grace et al. | 241/36 X |
| 4,919,343 | 4/1990 | Van Luik, Jr. et al. | 241/36 |
| 5,044,566 | 9/1991 | Mitsch | 241/46.04 |

*Primary Examiner*—Timothy V. Eley
*Attorney, Agent, or Firm*—Head Johnson & Kachigian

[57] ABSTRACT

A sewage grinder pump system for use in moving sewage, having a vertically oriented cylindrical pump motor housing, a bottom plate affixed to and closing the pump motor housing, a motor supported by the bottom plate within the pump motor housing, the motor having a shaft extending through an opening in the bottom plate, a grinder pump supported to a lower end of the bottom plate and connected to the motor shaft, a closure member affixed to the pump motor housing top end and having a level detector receiving portion providing a liquid level detector opening therein externally of the pump motor housing, an elongated liquid level detector having an upper end received within the liquid level detector opening, and a circuit connecting the liquid level detector to control the motor to thereby drive the grinder pump in response to detected liquid level.

7 Claims, 2 Drawing Sheets

SEWAGE HANDLING SYSTEM

CROSS-REFERENCE TO RELATED APPLICATIONS

This application is not related to any pending patent applications.

CROSS-REFERENCE TO MICROFICHE APPENDIX

This application is not related to any microfiche appendix.

BACKGROUND OF THE INVENTION

Most sewage systems work on the gravity system. That is, sewage generated in a building, home, commercial structure or otherwise, flows by gravity from a sewage drain extending from a building to a sewage drain collection system, into sewage mains which ultimately connect to a sewage treatment plant. At the sewage treatment plant the sewage is treated so that environmentally acceptable effluents can be released. This basic concept, of course, requires the sewage treatment plant to be at a lower level than all of the buildings in which sewage is generated. While this can be accomplished in many instances, frequently there arises the need for a sewage treatment system which is located in such a way that total gravity drainage cannot be employed. For instance, if a home is constructed in an area wherein a hill or a valley lies between it and a gravity sewage draining system then some method must be provided for conveying the sewage under pressure to the point where it can be connected with a gravity drainage system.

To accomplish this purpose, pressure sewage systems are provided for collecting sewage drained from a home or other type of building, or toilet facilities, to a collection point where the sewage is pumped, under pressure, through a line that ultimately connects with a gravity sewage drainage system or to a sewage treatment facility. By providing a collection system including a grinder pump, the sewage may not only be moved under pressure but a grinder pump makes it possible to use substantially smaller diameter sewage transport pipes extending between the sewage collection site and the sewage gravity flow system than can normally be employed where gravity alone is relied upon for moving sewage. Thus, the use of sewage handling systems including grinder pumps are well-known.

One problem in the known sewer handling systems that employ a grinder pump is that of providing a control system for turning the pump on and off in response to the quantity of sewage that has collected. Control systems typically function based on the level of sewage in a collection vessel. The level can be detected by a float actuated switch, however, the environment in which such switches function has made the standard liquid level detector switches unreliable. Another problem with known types of liquid level switches is that they must operate in a harsh environment for a very extended length of time. Due to the environment, it is a highly disagreeable job to enter into the area where liquid level switches are located to do maintenance and repair. For this reason, it has long been an object in the use of sewage grinder pumps in sewage handling systems to provide liquid level detector systems that are highly dependable and substantially maintenance free. For background information relating to pressure sewage systems and to sewage grinder pump systems, reference may be had to the following previously issued United States Patents which are incorporated herein by reference.

| U.S. Pat. No. | INVENTOR | TITLE |
|---|---|---|
| 3,667,692 | Grace | Pump Storage Grinder |
| 3,857,517 | Grace et al | Anti-Siphon and Pump Priming For Sewage Grinder Pump |
| 3,904,131 | Farrell et al | Pressure Sewer System |
| 4,014,475 | Grace et al | Combined Manway and Collection Tank For Sewage Grinder |
| 4,739,786 | Parkinson | Liquid Level Monitoring Assemblies |
| 4,919,343 | Van Luik et al | Anti-Flooding Sewage Grinder Pump Liquid Level Control System In Separately Mounted Canister |
| 5,044,566 | Mitsch | Sewage Pump With Self-Adjusting Cutters |

SUMMARY OF THE INVENTION

The disclosed invention herein provides an improved sewage handling system. The system includes a sewage collection tank with sidewalls, enclosed bottom and an open top, the sidewall has a sewage inlet opening that is connected to a home, a building or any other type of structure having one or more toilets therein that produce sewage. By means of a gravity fluid drainage system extending from the home or other building, sewage is drained through the sewage inlet opening into the collection tank.

The tank has a top plate with a central opening therethrough. An electric motor driven sewage grinder pump is supported by a pump housing, the pump housing being dimensioned to removably pass through the top plate central opening. The pump has a discharge outlet.

A pump housing flange is affixed to an upper end of the pump housing. The flange has a diameter greater than the top plate central opening so that the pump housing is removably supported within the sewage collection tank. A discharge conduit is connected to the pump discharge outlet and extends upwardly through an opening in the pump housing flange.

An upright manway housing is provided having a lower open end, an open top and a sidewall. The lower end of the manway housing is affixed and sealed to the top plate. Piping within the manway housing connects the discharge outlet with a housing sidewall outlet opening. A removable top cover closes and seals the manway housing open top.

Electrical conductors extend through the manway housing sidewall and into the pump housing. The conductors have connection with the sewage grinder pump through a control circuit.

A liquid level detector is supported by the pump housing and extends downwardly and parallel to the sewage grinder pump, the level detector extends within the lower sewage collection tank. The liquid level detector serves to detect and provide circuit actuation at three liquid levels. The first level is a liquid lower level at which the sewage grinder pump is turned off. The second level is an intermediate level at which the sewage grinder pump is turned on. The third level is a high level that is reached only when the sewage grinder pump has failed to pump sewage from the collection tank upon the sewage reaching the intermediate level.

A warning signal conductor extends through the manway housing sidewall and into the pump housing and connects to a circuit that is responsive to the liquid level detector for providing a warning signal when the liquid level in the sewage collection tank reaches the high level as detected by the third position of the liquid level detector.

The improved sewage handling system provides a unique and improved way of supporting a liquid level detector and a sewage grinder pump housing in a unitary arrangement with an integral flange so that the major components of the sewage system can be suspended from a single structure. The flange is preferably formed of plastic to thereby resist corrosion in the harsh environment in which the system is employed.

A better and more complete understanding of the invention will be obtained from the following detailed description of the preferred embodiments and the claims, taken in conjunction with the attached drawings.

DESCRIPTION OF THE PREFERRED EMBODIMENTS

Figure 1:
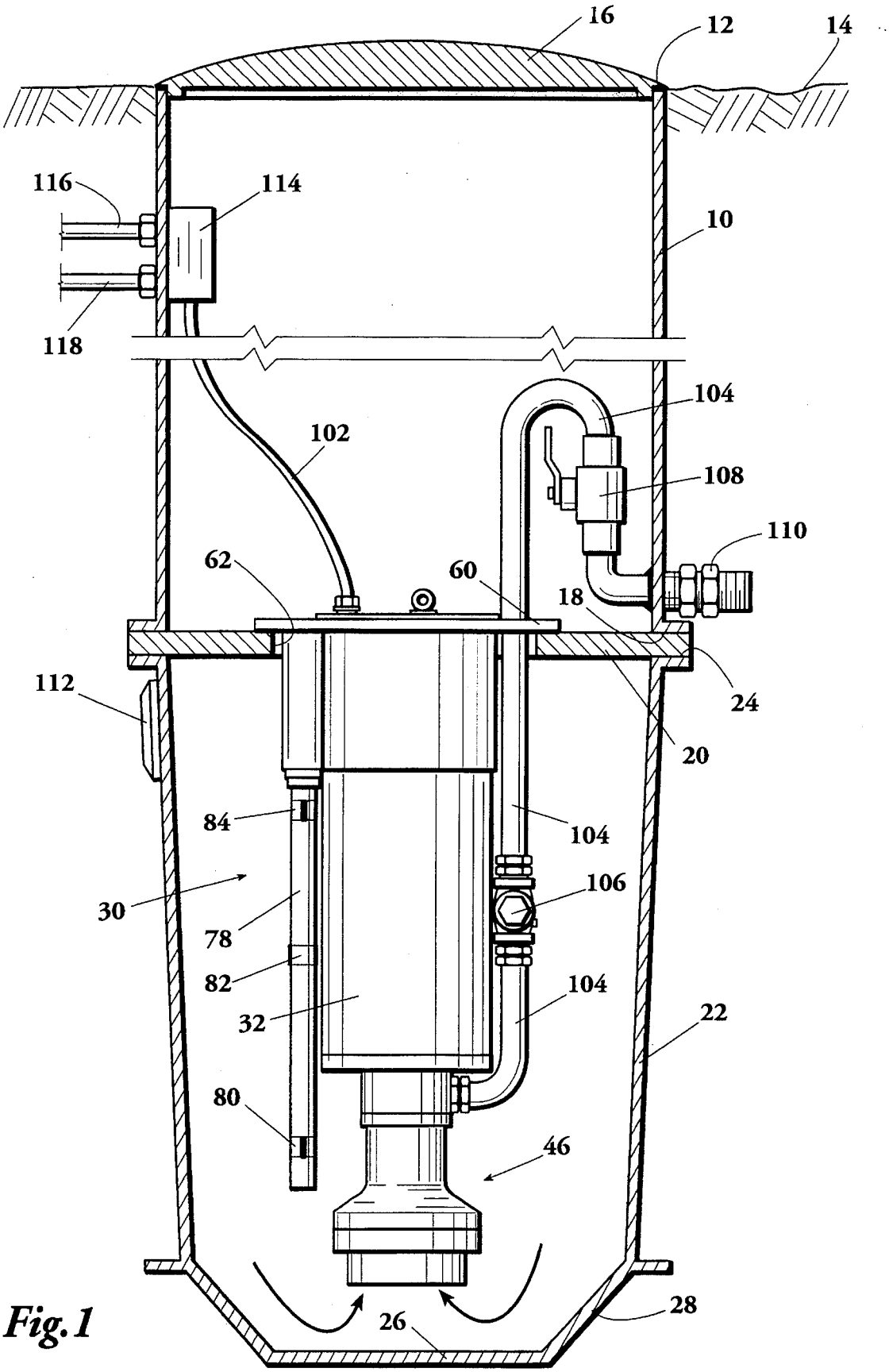
FIG. 1 is an elevational cross-sectional view of the improved sewage handling system showing an upper manway housing with a manway cover and a lower sewage collection tank having within it a sewage grinder pump and a liquid level control.

Referring now to the drawings and first to FIG. 1, a preferred embodiment of the improved sewage handling system of this invention is illustrated. The system includes a manway housing 10 that has an upper open end 12 positioned at ground level 14. The upper open end 12 is closed by manway cover 16.

The lower end 18 of manway housing 10 is supported by a plate 20 and below it is a sewage collection tank 22. The upper open top 24 of sewage collection tank 22 attaches to plate 20. The bottom 26 of sewage collection tank 22 is closed, and the bottom portion is preferably tapered at 28.

Positioned within the interior of sewage collection tank 22 is a grinder pump housing and grinder pump assembly, generally indicated by the numeral 30, that is illustrated in greater detail in the cross-sectional view of FIG. 2, to which reference will now be made.

The grinder pump assembly 30 includes a pump housing 32 having an open top end 34, the pump housing lower end 36 being closed by bottom plate 38 that has an opening 40 therethrough. Positioned within housing 32 is a pump motor 42 having a shaft 44 that extends through opening 40. Affixed to the lower end of bottom plate 38 is a grinder pump 46. The pump has a lower grinding head 48 and, above that, a positive displacement progressing cavity pump 50. Above the progressing cavity pump is a discharge cavity 52 having an outlet opening 54. Within discharge cavity 52 a spring actuated seal system 56 is positioned about shaft 44 to prevent sewage from entering the interior of pump housing 32 through opening 40.

To support the pump housing 32 with its enclosed pump motor 42 and attached grinder pump 46 within sewage collection tank 22, a closure member 58 is employed. The closure member 58, which preferably is cast of plastic material, has an integral radially extending flange 60 that, when the unit is installed, rests on the top of plate 20 as shown in FIG. 1. The entire grinder pump assembly 30 is removable through an opening 62 in plate 20. As further seen in FIG. 2, closure member 58 includes a downwardly extending tubular portion 64 that telescopically receives upper end 34 of pump housing 32. An integral septum 66 formed as a part of closure member 58 functions to close upper end 34 of pump housing 32. Pump housing 32 may be secured to downwardly extending tubular portion 64 by threaded attachment or by sealably bonding housing 32 to tubular portion 64 so as to create an air tight environment for pump motor 42. In order to test the integrity of the watertight seals after assembly, an air valve 68 is placed into septum 66. Air valve 68 is of the type employed for pressuring tube-less tires so that a source of air pressure may be applied through the valve to form positive air pressure within the interior of pump housing 32.

An important aspect of closure member 58 is the provision of an integral liquid level switch detector portion 70 providing an opening 72 having a lower end 74. Supported within opening 72 is the upper end 76 of an elongated liquid level detector 78. Detector 78 has provisions for providing electrical signals in response to three fluid levels. The first is a lower band 80. A signal is generated when the level falls below lower band 80. This signal is used in a circuit to turn pump motor 42 off, if the motor is running to pump fluid from collection tank 22. A second level detector band 82 is spaced above lower band 80. An electrical signal generated by the switch when liquid level reaches band 82 functions to turn motor 42 on to thereby energize pump 46 to reduce the level of fluid within sewage collection tank 22. A third detector band 84 spaced above second detector band 82 provides an electrical signal used for indicating an emergency condition. That is, when the liquid level within sewage collection tank 22 reaches the level of third band 84, a warning or danger signal is provided since the fact that the level has reached that which is detected by the third detector band 84 indicates that the system has not functioned to maintain the proper maximum level within collection tank 22. Therefore, some problem exists which must be addressed, otherwise sewage will continue to collect until collection tank 22 is completely filled, at which time it will back up in the sewage collection lines leading to the tank and, ultimately, into toilet facilities from which the sewage is originated.

Detector bands 80,82 and 84 of level detector 78 can function in a variety of ways to indicate fluid level. A common means employed for detecting fluid level is if bands 80, 82 and 84 are conductive so that conductance of a circuit increases when the fluid level contacts the bands. Bands 80, 82 and 84 may function to detect liquid level by change in capacitance that occurs in the presence of the liquid to provide signal information to circuitry for control of the operation of motor pump 42 and for providing a warning signal.

The location of septum 66 within closure member 58, which is spaced well below flange 60, provides an internal space 86 in which a control circuit 88 is positioned. The control circuit has conductors 90 extending to detachable connector 92 which in turn connects with conductors 94 and 96 extending to level detector 78 and motor 42 respectively.

A cover plate 98 removably closes the upper end of closure member 58, the cover plate having a seal conductor passageway 100 therein whereby a cable 102 passes. Cable 102 serves to supply electrical energy for circuit 88 by which motor 42 is operated as well as to carry a conductor for providing an emergency signal. An emergency signal can be generated in a remote location, such as within a house from which sewage is taken to drain into sewage collection tank 22. The signal device (not shown) may be a noise generator, such as a bell or horn or a light.

Figure 2:
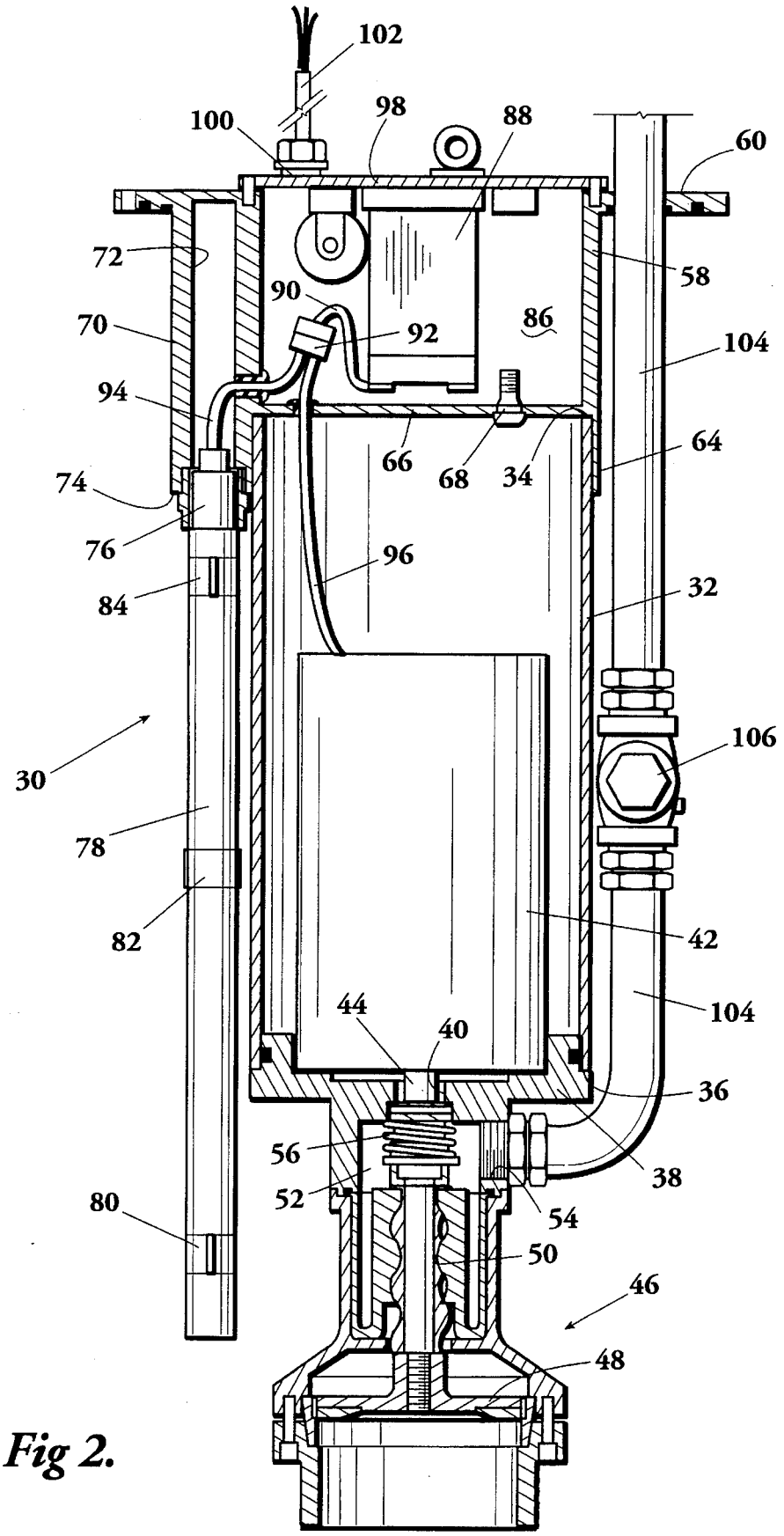
FIG. 2 is an enlarged cross-sectional view of the sewage grinder pump as supported in the pump housing that is suspended within the sewage collection tank and showing a closure member for closing the pump motor housing. The closure member includes an integral flange and downwardly extending integral tubular extensions. The first tubular extension receives a motor housing that contains the sewage grinder pump motor with the sewage grinder pump supported at the motor housing lower end. The other closure member tubular extension receives a liquid level detector that is supported adjacent to and paralleled to the motor housing.

As seen both in FIGS. 1 and 2, there is a sewage outlet conduit 104 that extends through an opening in flange 60, conduit 104 being connected at its lower end to pump outlet opening 54. A check valve 106 is provided within conduit 104 to resist the flow of sewage back through the pump and into sewage collection tank 22 when motor 42 is not energized. As seen in FIG. 1, within manway housing 10, a manual control valve 108 is provided in line 104 so that when it is necessary to remove the grinder pump assembly 30, valve 108 can be closed to prevent sewage from backing up through the line.

A connection 110 is attached to the end of conduit 104 to receive a sewage conduit (not shown) by which sewage under pressure is carried away from the system. Such sewage conduit typically traverses a distance necessary so that the outer end thereof is connected to a gravity sewage collection system or other sewage disposal system.

As shown in FIG. 1, sewage collection tank 22 has a sewage inlet 112. A sewage drain pipe (not shown) extending from a home, office, shop or other type of building having one or more toilet facilities connects by gravity flow to sewage inlet 112 where sewage is delivered into the interior of sewage collection tank 10.

Positioned within the interior of manway housing 10 is junction box 114 by which flexible conductor 102 is connected to conduits 116 and 118. Conduit 116 connects to a power source whereby electrical energy is supplied to pump motor 42 and circuitry 88. Conduit 118 contains conductors for carrying an emergency indicating signal when the fluid level within sewage collection tank 22 reaches third band 84 of level detector 78 to provide a warning signal.

The sewage collection system herein provides a unique, economical and highly effective way of mounting a pump motor housing 32 in conjunction with a vertical liquid level detector 78, both supported by an integral closing member 58 in an arrangement wherein these components are supported in contiguous side-by-side relationship for easy assembly and for removal for repair or maintenance. The improved combination of a liquid level detector and motor housing all mounted and extending from the same integral closure member 58 assures simplicity of installation and reduces the possibility of failure of the system. The system of this disclosure is particularly advantageous when compared with systems that employ float actuated liquid detectors with their attendant mechanical operating features that are subject to wear and failure.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved sewage handling system comprising:

a sewage collection tank having a sidewall, a closed bottom and an open top, the sidewall having a sewage inlet opening therein;

a top plate closing said collection tank open top and having a central opening therethrough;

an electric motor driven pump supported by a pump housing, the pump housing being dimensioned to removably pass through said top plate central opening, the pump having a discharge outlet;

a pump housing flange affixed to an upper end of said pump housing having a diameter greater than said top plate central opening whereby said pump housing is removably supported within said sewage collection tank;

a discharge conduit connected to said pump discharge outlet and extending upwardly through an opening in said pump housing flange;

an upright manway housing having a lower open end, an open top and a sidewall, the lower end being sealably affixed to said top plate, the sidewall having an outlet opening therein;

piping within said manway housing removably connecting said discharge conduit with said sidewall outlet opening;

a top cover removably and sealably closing said manway housing open top;

electrical conductors extending sealably through said manway housing sidewall and into said pump housing having connection with said pump through a control circuit;

a liquid level detector supported by said pump housing and extending downwardly and parallel to said pump within said lower sewage collection tank, the liquid level detector having means to detect and provide circuit actuation at three liquid levels, the first level being a liquid lower level at which said pump is turned off, the second being an intermediate level at which said pump is turned on, and the third being a high level that is reached only when said pump has failed to pump sewage from collection tank upon the sewage level reaching said intermediate level; and a warning signal conductor extending sealably through said manway housing sidewall and into said pump housing and connected to said liquid level detector for providing a warning signal when the liquid level in said sewage collection tank reaches said high level.

2. A sewage pump system for use in moving sewage, comprising:

a vertically oriented cylindrical pump motor housing having a sidewall and open top and bottom end;

a bottom plate affixed to and closing said pump motor housing bottom end and having an opening therethrough;

a motor supported by said bottom plate within said pump motor housing, the motor having a shaft extending through said bottom plate opening;

a pump supported to a lower end of said bottom plate and connected to said motor shaft, said grinder pump having an intake and an outlet opening, the outlet opening being connected to a conduit for the passage of sewage therethrough;

a closure member affixed to said pump motor housing top end, the closure member having a level detector receiving portion providing a liquid level detector opening therein externally of said pump motor housing;

an elongated liquid level detector having an upper and a lower end, the upper end being received within said liquid level detector opening, the liquid level detector having means to detect the level of liquid exterior of said pump motor housing; and circuit means connecting with said liquid level detector to control said motor to thereby drive said pump in response to detected liquid level.

3. A sewage pump system according to claim 2 where said closure member has an upper end and a lower end and includes a tubular extension on the lower end telescopically engaging said pump motor housing top end.

4. A sewage pump system according to claim 3 wherein said closure member has a tubular upper portion separated from said lower end tubular extension by a septum, the septum forming a top closure of said motor housing.

5. A sewage pump system according to claim 4 wherein said circuit means is contained, at least in part, within said closure member tubular upper portion.

6. A sewage pump system according to claim 2 wherein said tubular level detector comprises:

an elongated vertical body having an upper end and a lower end, and having a first level detecting band positioned on said body adjacent said bottom end for indicating a lower liquid level and a second level detecting band on said body spaced above said first band for indicating an upper fluid level.

7. A sewage system according to claim 6 including a third level detecting band on said body spaced above said second band for indicating an emergency fluid level.

* * * * *